US011201402B1

(12) United States Patent
Huangfu et al.

(10) Patent No.: US 11,201,402 B1
(45) Date of Patent: Dec. 14, 2021

(54) PHASE SHIFTER ASSEMBLY

(71) Applicants: ROSENBERGER TECHNOLOGIES CO., LTD., Suzhou (CN); ROSENBERGER TECHNOLOGIES LLC, Budd Lake, NJ (US)

(72) Inventors: Youfang Huangfu, Suzhou (CN); Yongzhong Li, Suzhou (CN); Suyang Bao, Suzhou (CN); Min Shen, Suzhou (CN); Dongfeng Ding, Suzhou (CN); Yang Yang, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/372,343

(22) Filed: Jul. 9, 2021

(30) Foreign Application Priority Data

Oct. 10, 2020 (CN) ..... 202011077910.1

(51) Int. Cl.
*H01Q 3/32* (2006.01)
*H01P 1/18* (2006.01)

(52) U.S. Cl.
CPC ..... *H01Q 3/32* (2013.01)

(58) Field of Classification Search
CPC ..... H01Q 21/00; H01Q 3/32; H01Q 3/36; H01Q 3/38; H01P 1/18
See application file for complete search history.

(56) References Cited

U.S. PATENT DOCUMENTS 6,198,458 B1 * 3/2001 Heinz ..... H01Q 1/125 343/757
6,538,619 B2 * 3/2003 Heinz ..... H01Q 1/125 343/757
7,161,445 B2 * 1/2007 Yoon ..... H01P 1/185 333/161
7,170,466 B2 * 1/2007 Janoschka ..... H01P 1/184 333/156
7,554,502 B2 * 6/2009 Duan ..... H01Q 1/246 343/757
10,833,407 B2 * 11/2020 Yang ..... H01Q 1/246

* cited by examiner

*Primary Examiner* — Tho G Phan
(74) *Attorney, Agent, or Firm* — Anova Law Group, PLLC

(57) ABSTRACT

A phase shifter assembly includes: a first phase shifter including a first through-hole; a second phase shifter including a second through-hole and disposed at a side of the first phase shifter; a first gear including a third through-hole and disposed at a side of the second phase shifter facing away from the first phase shifter; a rack configured to drive, through driving the first gear, the second phase shifter to move relative to the first phase shifter, to adjust an electrical tilt angle of an antenna corresponding to the phase shifter assembly; and a first reversing mechanism disposed between the first gear and the rack and engaged with the first gear and the rack, respectively, making a direction of a component of a linear velocity at an electrical contact between the first phase shifter and the second phase shifter in a moving direction of the rack is opposite to the moving direction of the rack.

16 Claims, 7 Drawing Sheets

PHASE SHIFTER ASSEMBLY

CROSS-REFERENCE TO RELATED APPLICATION

This application claims priority to Chinese Patent Application No. CN202011077910.1, filed on Oct. 10, 2020, the entire contents of which are incorporated herein by reference.

TECHNICAL FIELD

The present disclosure relates to the technical field of communications and, more particularly, to a phase shifter assembly.

BACKGROUND

An arc-shaped phase shifter assembly is known in the existing technology. When an input movement direction of the arc-shaped phase shifter assembly faces toward an IN port, an electrical tilt angle of an antenna corresponding to the phase shifter becomes smaller. When the input movement direction of the arc-shaped phase shifter assembly faces away from the IN port, the electrical tilt angle of the antenna corresponding to the phase shifter becomes larger. In the existing technology, a technical solution to achieve the reverse effect does not exist.

When an arc-shaped phase shifter is used in an electrically adjustable antenna, the IN port of the phase shifter needs to be electrically connected to an antenna input port. When a linear driving direction of an input is along a direction from the IN port of the phase shifter to the antenna input port, an electric tilt angle of the antenna becomes smaller. When the linear driving direction of the input is along an opposite direction, the electric tilt angle of the antenna becomes larger.

A ruler showing the electrical tilt angle of the antenna is often disposed adjacent to the antenna input port. At the time of product shipment, a customer may require the antenna to be positioned in a minimum tilt angle state. In this case, the ruler extends most out of the antenna. As such, the ruler is likely to be damaged during shipping. The more the ruler extends, the smaller the tilt angle is. This seems to be contrary to a normal logic, thereby making the customer less satisfied.

In a cavity type phase shifter that is widely used in antenna industry, when the linear driving direction of the input is along the direction from the IN port of the phase shifter to the antenna input port, the electric tilt angle of the antenna becomes larger, which is generally more acceptable by the customer. However, the cavity type phase shifter is lacking many advantages of the arc-shaped phase shifter. Though a technical solution that rotates the installation of the arc-shaped phase shifter by 180° may provide a direction reversal function, it does increase a length of the cables connecting the phase shifter, thereby increasing cost.

SUMMARY

In accordance with the disclosure, there is provided a phase shifter assembly. The phase shifter assembly includes: a first phase shifter including a first through-hole; a second phase shifter including a second through-hole and disposed at a side of the first phase shifter; a first gear including a third through-hole and disposed at a side of the second phase shifter facing away from the first phase shifter; a rack configured to drive, through driving the first gear, the second phase shifter to move relative to the first phase shifter, to adjust an electrical tilt angle of an antenna corresponding to the phase shifter assembly; and a first reversing mechanism disposed between the first gear and the rack and engaged with the first gear and the rack, respectively. The first through-hole, the second through-hole, and the third through-hole are aligned with each other. The first reversing mechanism makes a direction of a component of a linear velocity at an electrical contact between the first phase shifter and the second phase shifter in a moving direction of the rack is opposite to the moving direction of the rack.

BRIEF DESCRIPTION OF THE DRAWINGS

To more clearly illustrate the technical solution of the present disclosure, the accompanying drawings used in the description of the disclosed embodiments are briefly described hereinafter. The drawings described below are merely some embodiments of the present disclosure. Other drawings may be derived from such drawings by a person with ordinary skill in the art without creative efforts and may be encompassed in the present disclosure.

Figure 1:
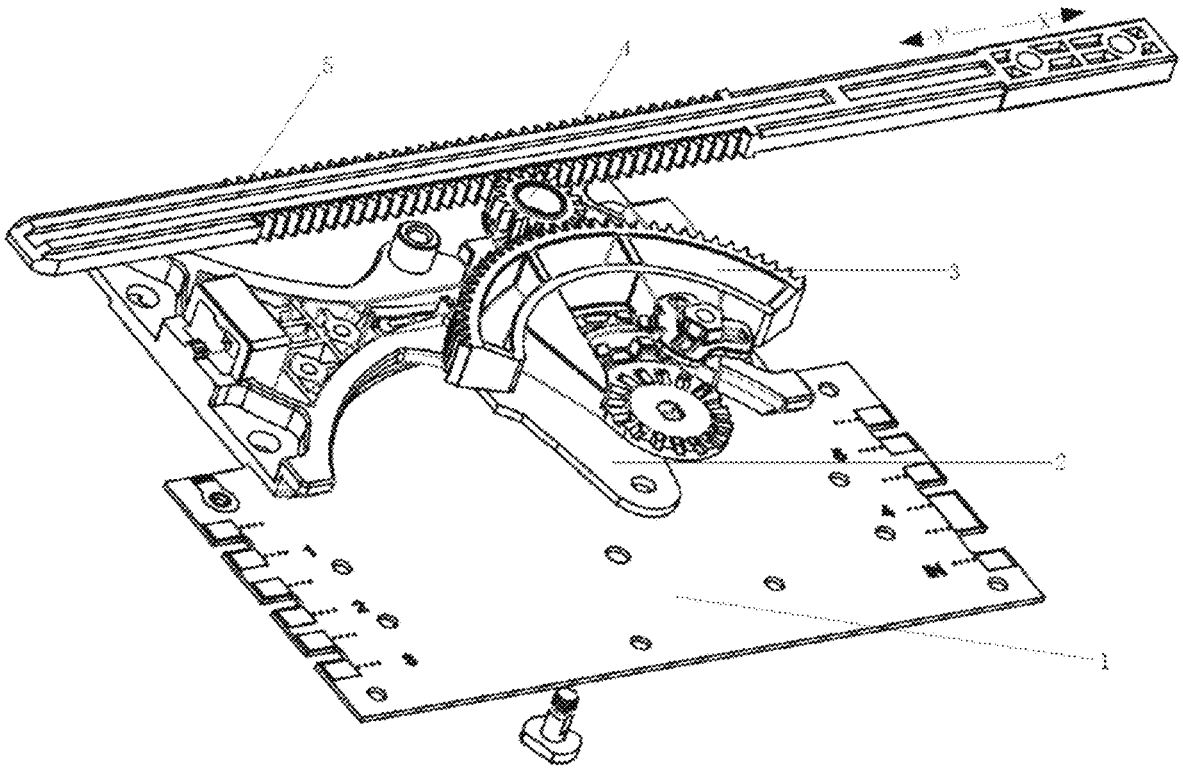
FIG. 1 is a schematic diagram of a phase shifter assembly according to an example embodiment of the present disclosure.

Other features, characteristics, advantages, and benefits of the present disclosure will become more apparent through the following detailed description with reference to accompanying drawings.

DETAILED DESCRIPTION OF THE EMBODIMENTS

Embodiments of the present disclosure are described in detail below with reference to the accompanying drawings. Same or similar reference numerals in the drawings represent the same or similar elements or elements having the same or similar functions throughout the specification. It will be appreciated that the described embodiments are some rather than all of the embodiments of the present disclosure.

Other embodiments obtained by those having ordinary skills in the art on the basis of the described embodiments without inventive efforts should fall within the scope of the present disclosure.

The following technical issues exist in the existing technology. That is, a phase shifter assembly in the existing technology either has product damage risk and shipping inconvenience caused by overly extending the ruler out of the antenna, or increases cost by providing longer cables connecting the phase shifter. In the existing phase shifter, the more the ruler extends, the smaller the tilt angle is, which is contrary to the normal logic and makes the customer less satisfactory.

To address the foregoing technical issues, the present disclosure provides a phase shifter assembly. FIG. 1 is a schematic diagram of a phase shifter assembly according to an example embodiment of the present disclosure. As shown in FIG. 1, the phase shifter assembly includes a first phase shifter 1 including a first through-hole, a second phase shifter 2 including a second through-hole and disposed on top of the first phase shifter 1 as shown in FIG. 1, a first gear 3 including a third through-hole and disposed on a side of the second phase shifter 2 facing away from the first phase shifter 1 (upper side direction in FIG. 1), a rack 5, and a first reversing mechanism 4.

The first through-hole, the second through-hole, and the third through-hole are aligned with each other in an assembled state. In some embodiments, the three through-holes may be mechanically coupled by a certain physical connection method, such as a rivet, a threaded element, or another suitable connection mechanism. The connection method is not critical for providing a reversing function.

In some embodiments, the rack 5 is configured to have the first gear 3 drive the second phase shifter 2 to move relative to the first phase shifter 1, such that the electrical tilt angle (may also be referred as tilt angle in the present disclosure) of the antenna corresponding to the phase shifter assembly may be adjusted. In this case, driving the second phase shifter 2 by the rack 5 through the first gear 3 does not mean that the rack 5 and the first gear 3 are directly coupled. The rack 5 and the first gear 3 may be coupled indirectly through another mechanism.

In some embodiments, the first reversing mechanism 4 is disposed between the first gear 3 and the rack 5 and engages with the first gear 3 and the rack 5. As such, a component of a linear velocity at an electrical contact between the first phase shifter 1 and the second phase shifter 2 in a moving direction of the rack 5 is opposite to the moving direction of the rack 5. In some embodiments, the first phase shifter 1 includes ports (e.g., port corresponding to the number 1 or 2 or 3 or 4 or 5 in FIG. 1) that connect to radiating elements of the antenna. The first phase shifter 1 is fixed and the second phase shifter 2 moves relatively to the first phase shifter 1 such that a position of the electrical contact between the first phase shifter 1 and the second phase shifter 2 changes, which in turn achieving phase shifting for a signal radiated by the radiating elements corresponding to the phase shifter.

In some embodiments, when the first reversing mechanism 4 is configured to achieve a linear driving direction of a phase shifter input toward the IN port (e.g., X direction in FIG. 1), the electrical tilt angle of the antenna corresponding to the phase shifter becomes larger (i.e., the component of the linear velocity at the electrical contact between the first phase shifter 1 and the second phase shifter 2 in a moving input direction is opposite to an input moving direction.) When the linear driving direction of the input faces away from the IN port (e.g., X' direction in FIG. 1), the electrical tilt angle of the antenna corresponding to the phase shifter becomes smaller (i.e., the component of the linear velocity at the electrical contact between the first phase shifter 1 and the second phase shifter 2 in a moving input direction is opposite to an input moving direction.)

Specifically, when the rack 5 moves in the X direction, tooth position of the rack 5 engages with the first reversing mechanism 4 (e.g., a gear). The first reversing mechanism 4 rotates clockwise around a central axis. The first reversing mechanism 4 and the first gear 3 are engaged with each other to drive the first gear 3 to rotate counterclockwise around an axis. The first gear 3 drives the second phase shifter 2 to rotate counterclockwise. A direction of the component of the linear velocity of the electrical contact between the second phase shifter 2 and the first phase shifter 1 in the X direction is the X' direction. On the contrary, when the rack 5 moves in the X' direction, the tooth position of the rack 5 engages with the first reversing mechanism 4. The first reversing mechanism 4 rotates counterclockwise around the central axis. The first reversing mechanism 4 engages with the first gear 3 to drive the first gear 3 to rotate clockwise around the axis. The first gear 3 drives the second phase shifter 2 to rotate clockwise. The direction of the component of the electrical connection C between the second phase shifter 2 and the first phase shifter 1 is the X direction, which is opposite to the input moving direction X', thereby achieving the direction reversal function of the phase shifter.

Under the circumstance that a factory setting requires the tilt angle to be at a minimum position, the rack indicating the tilt angle in FIG. 1 is located at a left-most position. Thus, a portion of the ruler extending out of a lower end cover of the antenna is restricted, thereby improving antenna shipping and reducing the risk of being damaged. The rack can function as a ruler and is configured to indicate an electrical tilt angle of an antenna corresponding to the phase shifter assembly. As the rack moves toward the right side, the tilt angle becomes larger. In some embodiments, the rack can be moved manually.

In the embodiments of the present disclosure, the phase shifter assembly provides a reversal solution by means of the first reversing mechanism. That is, when the linear driving direction of the input faces toward the IN port, the electrical tilt angle of the antenna corresponding to the phase shifter becomes larger. When the linear driving direction of the input faces away from the IN port, the electrical tilt angle of the antenna corresponding to the phase shifter becomes smaller. As such, the ruler may not overly extend out of the antenna when the antenna is in the minimum tilt angle state. The risk of being damaged during shipping and installation can be reduced. The ruler indicates the angle in a more logic manner. The customer satisfaction is improved. The length of the cables connecting the phase shifter may not increase.

In addition to the drawback of the relative relationship between the tilt angle and the moving direction, the phase shifter in the existing technology has another drawback that the first phase shifter and the second phase shifter are fastened to each other by using an inverse clamping feature of a sliding plate to clamp together the two phase shifters moving relative to each other. Although the sliding plate and phase plates are well fitted, sliding friction exists between the inverse clamping feature of a phase shifter fastener and the first phase shifter when the electrical tilt angle of the antenna corresponding to the phase shifter is adjusted. As the number of electric tilt adjustments increases, the phase plate may have obvious scratches. Thus, a life span of the phase shifter may be shortened. A driving force for adjustment may have to be increased, thereby reducing driving efficiency.

Figure 2:
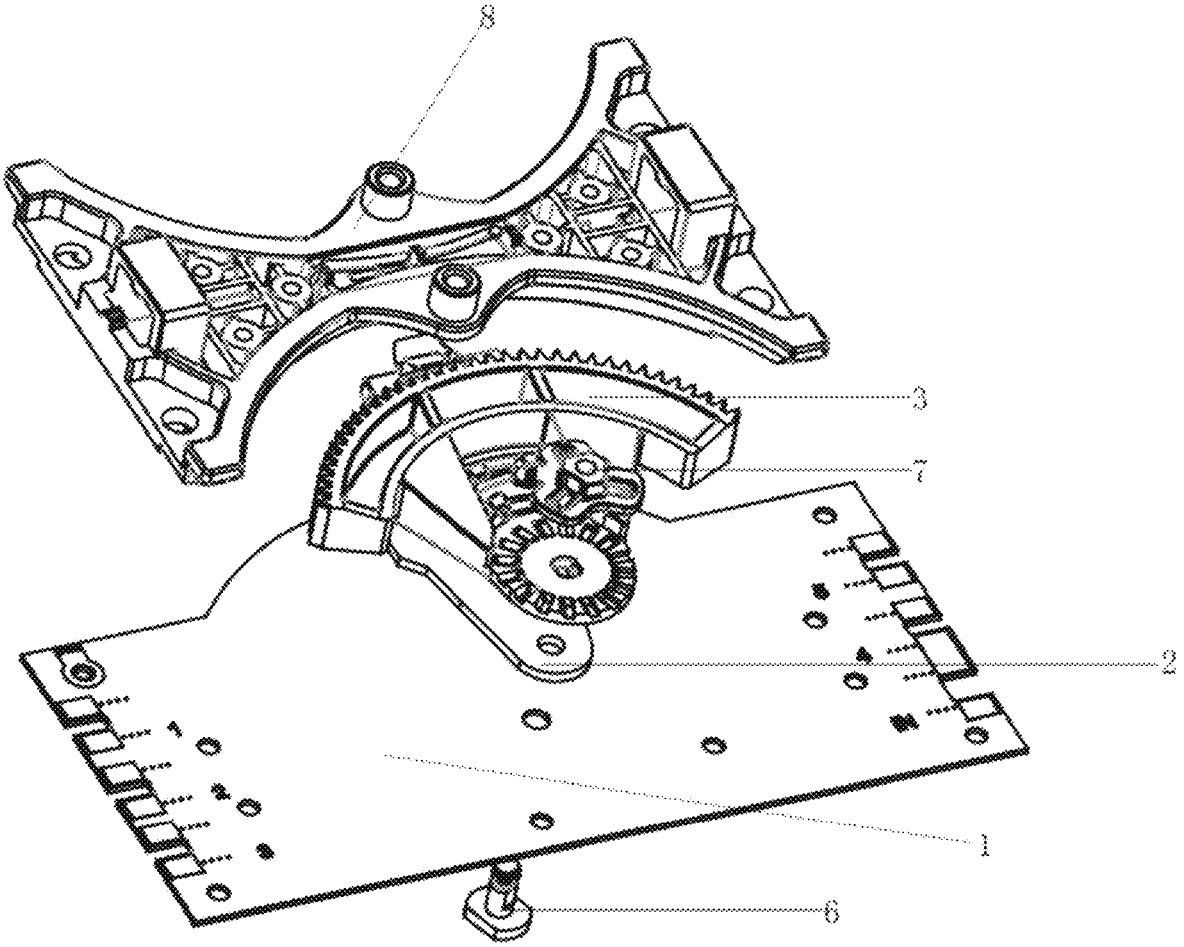
FIG. 2 is a schematic diagram of a phase shifter assembly according to another example embodiment of the present disclosure.

To address the foregoing technical issues, the present disclosure provides another phase shifter assembly. FIG. 2 is a schematic diagram of a phase shifter assembly according to another example embodiment of the present disclosure. As shown in FIG. 2, the phase shifter assembly includes a first phase shifter 1 including a first through-hole, a second phase shifter 2 including a second through-hole and disposed on a side of the first phase shifter 1, a first gear 3 including a third through-hole and disposed on a side of the second phase shifter 2 facing away from the first phase shifter 1, a rack (not shown), and a support member 8 for supporting the rack.

The first through-hole, the second through-hole, and the third through-hole are aligned with each other in an assembled state. In some embodiments, the three through-holes may be mechanically coupled by a certain physical connection method, such as a rivet, a threaded element, or another suitable connection mechanism. The connection method is not critical for providing a reversing function.

In some embodiments, the rack is configured to have the first gear 3 drive the second phase shifter 2 to move relative to the first phase shifter 1, such that the electrical tilt angle of the antenna corresponding to the phase shifter assembly may be adjusted.

In some embodiments, the first gear 3 includes an end elastic member (labeled as 33 in FIG. 3) at an end facing away from the third through-hole. In the assembled state, the end elastic member 33 is coupled with the support member 8, such that the support member 8 presses the second phase shifter 2 on the first phase shifter 1 through the end elastic member 33.

In some embodiments, as shown in FIG. 2, an end elastic feature of the first gear 3 contacts with the support member 8. A pressing force provided by the support member 8 presses the end of the first gear 3. Then, the pressing force passes through the end elastic feature to press the second phase shifter 2, such that the second phase shifter 2 is stably pressed on the first phase shifter 1. When in operation, the second phase shifter 2 is prevented from damaging the first phase shifter 1, thereby extending the life span of the first phase shifter 1.

In some embodiments, the first gear 3 and the support member 8 are made of materials having low friction coefficients, such that a friction force during sliding is reduced, and a transmission efficiency is improved. In general, the support member 8 and the end elastic member 33 of the first gear 3 are structurally coordinated to fasten together the first phase shifter 1 and the second phase shifter 2, such that no additional structure such as the inverse clamping feature is needed to fasten the phase shifters. The sliding friction no longer exists between the phase shifter fastener and the first phase shifter when the electrical tilt angle of the antenna corresponding to the phase shifter is adjusted and no obvious scratches on the phase plate occur as the number of adjustments increases. The life span and the electrical characteristics stability of the phase shifter assembly are improved. In other words, at the same time that the two phase shifters are fastened, the problem of the life span of the first phase shifter being shortened due to friction between the first phase shifter and the phase shifter fastener is also resolved.

In addition, traditional phase shifter assembly often uses a metal dome and a plastic shaft for fastening, in which a fastening force is not adjustable. Due to manufacturing tolerances of the plastic shaft, the metal dome, the phase shifter fastener, and the thickness of phase shifters, fastening consistency cannot be guaranteed, thereby degrading the electrical characteristics of products. In some embodiments, as shown in FIG. 2, a first screw 6 and a first nut 7 are illustrated to address the foregoing drawback in the existing phase shifter assembly. The first gear 3 in FIG. 3, the first screw 6 in FIG. 4, and elastic compression structure included in the first nut 7 in FIG. 5 and FIG. 6 have two different structures. As can be seen from the foregoing drawings, the phase shifter assembly also includes the first screw 6 and the first nut 7. In the assembled state, the first screw 6 passes through the first through-hole, the second through-hole, and the third through-hole to couple with the first nut 7 to provide the fastening force among the first phase shifter 1, the second phase shifter 2, and the first gear 3. In other words, the present disclosure provides adjustability of the fastening force. The thickness of the phase shifters and the phase shifter fastener and matching tolerances no longer affect accuracy of the fastening force. Consistency of the fastening force is ensured. The electrical characteristics stability of the phase shifters is ensured.

In some embodiments, at least a portion of a cross-section of the first screw 6 is a first D-shaped cross-section. At least one of the second through-hole or the third through-hole includes a second D-shaped cross-section matching the first D-shaped cross-section. In this case, both the second through-hole and the third through-hole may have the second D-shaped cross-section matching the first D-shaped cross-section, or only one of the second through-hole and the third through-hole may have the second D-shaped cross-section matching the first D-shaped cross-section, as long as the first screw 6 does not rotate with rotation of the first nut 7. As such, the rotation of the first nut 7 does not cause the first screw 6 to rotate accordingly. Thus, the fastening force is provided among the first phase shifter 1, the second phase shifter 2, and the first gear 3.

In some embodiments, the first nut 7 includes an elastic pressing member and is also called the first elastic nut 7. The elastic pressing member is configured to deform elastically to provide the fastening force among the first phase shifter 1, the second phase shifter 2, and the first gear 3. Specifically, the first screw 6 and the first elastic nut 7 are coupled for fastening. After a torque reaches a certain value, the fastening force between the second phase shifter 2 and the first phase shifter 1 remains constant. The torque may be adjusted to adjust an elastic characteristic of the first elastic nut 7 and an amount of interference between the first elastic nut 7 and the first gear 3, thereby achieving rapid adjustability of the fastening force. In some embodiments, a magnitude of the fastening force is irrelevant to the thickness of the second phase shifter 2, the first phase shifter 1, and the first gear 3. Thus, the thickness and the matching tolerances of the first phase shifter 1, the second phase shifter 2, and the first gear 3 have no effect on the accuracy of the fastening force, thereby ensuring the consistency of the fastening force.

Figure 5:
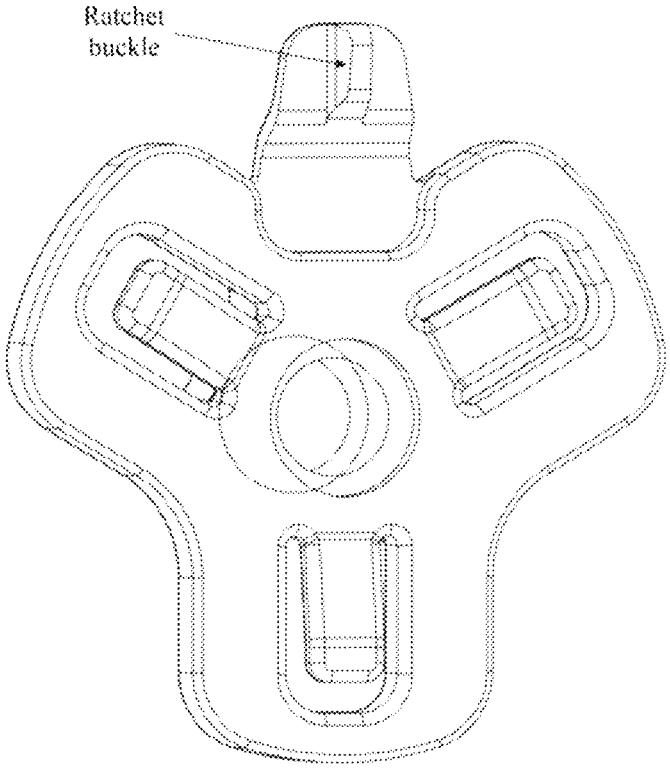
FIG. 5 is a structural diagram of an elastic pressing member in the first screw included in the phase shifter assembly according to an example embodiment of the present disclosure.
Figure 6:
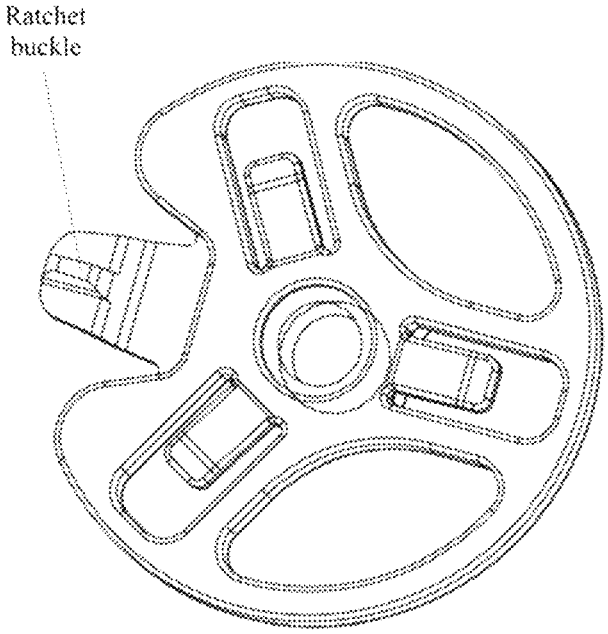
FIG. 6 is a structural diagram of an elastic pressing member in the first screw included in the phase shifter assembly according to another example embodiment of the present disclosure.

As shown in FIG. 5 and FIG. 6, the elastic pressing member includes multiple cantilever elastic structures evenly distributed along a circumferential direction around the center position of the first nut 7. In some embodiments, the elastic pressing member also includes a ratchet buckle, and the first gear 3 includes at least one recess 31 around the third through-hole. In the assembled state, the ratchet buckle is mechanically coupled with one of the at least one recess 31. Thus, the first nut 7 is prevented from being loosened in the operation, thereby ensuring the stability of the phase shifter assembly. In other words, the ratchet buckle is used to prevent a fastened nut from being loosened, thereby ensuring a stable positive pressure between the phase shifters and the reliability of radio frequency performance.

Moreover, the cantilever elastic structures are often used in the design of the existing phase shifters. The fastening force is applied to the cantilever elastic structures to ensure tightening of the sliding plate. However, in practical applications, the fastening force on the cantilever elastic structures may change due to fatigue and creep.

Figure 3:
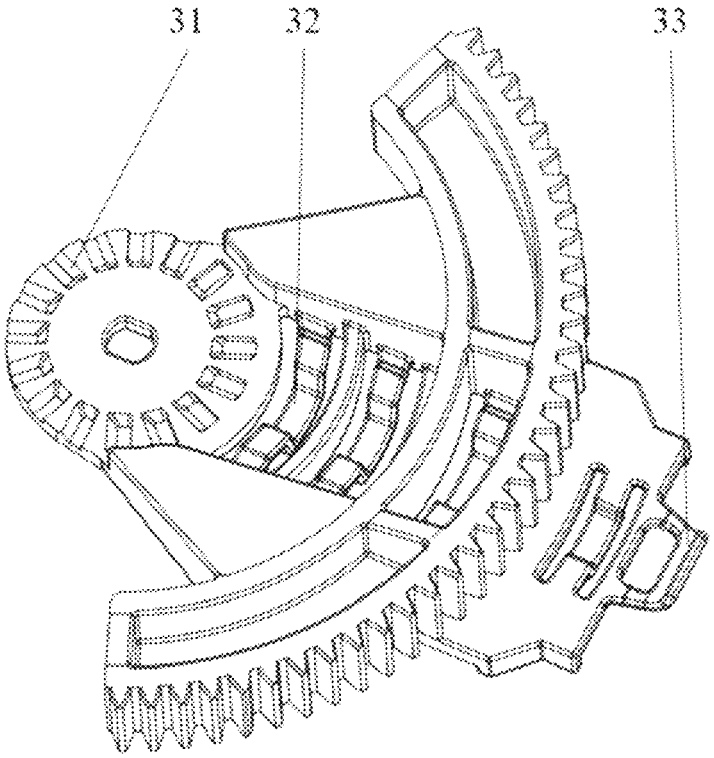
FIG. 3 is a structural diagram of a first gear included in a phase shifter assembly according to an example embodiment of the present disclosure.
Figure 4:
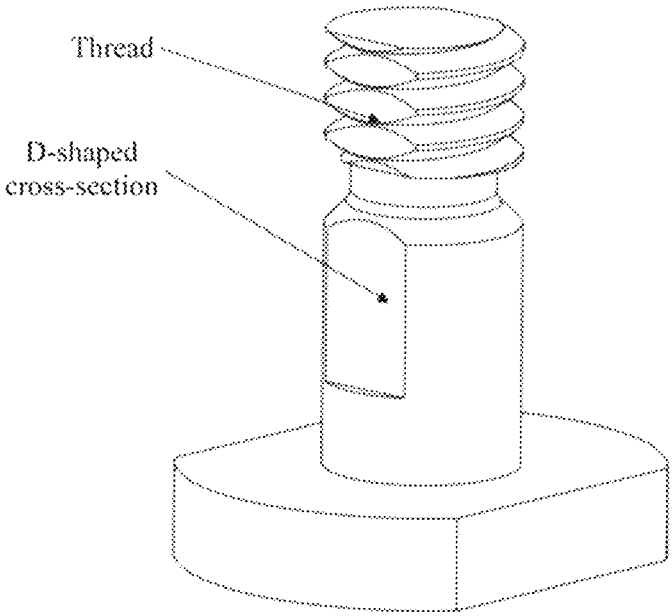
FIG. 4 is a structural diagram of a first screw included in the phase shifter assembly according to an example embodiment of the present disclosure.

In some embodiments, to address the foregoing drawback of the existing phase shifter assembly, the present disclosure provides another phase shifter assembly. As shown in FIG. 3, the first gear 3 includes a bridge elastic member 32 associated with a pathway of the first phase shifter 1 and/or the second phase shifter 2 to apply a force on the second phase shifter 2 toward the first phase shifter 1 in the assembled state. The bridge elastic member 32 includes a 1-bridge elastic member, a 2-bridge elastic member, or an N-bridge elastic member. The bridge elastic member 32 of the first gear 3 is arranged along the pathway of the first phase shifter 1 and the second phase shifter 2. The positive pressure provided by the bridge elastic member 32 is evenly applied directly above the pathway to ensure a stable positive pressure and to obtain more stable electrical performance. In other words, the foregoing technical features overcome the fatigue and the slow degradation to ensure the stability of the structure and the electrical performance.

In addition, the phase shifter assembly shown in FIG. 2 may also include the first reversing mechanism 4 as shown in FIG. 1. However, the objective of the technical solution shown in FIG. 2 is to solve the technical problem of being damaged by the inverse clamping feature for fastening the first phase shifter 1 during the operation of the phase shifter assembly and shortening the life span of the phase shifter assembly. Thus, the first reversing mechanism 4 is not a necessity at the same time. The problem of shortening the life span may be solved without the first reversing mechanism 4. However, a concurrent presence of the first reversing mechanism 4 may resolve the direction reversal problem at the same time.

Figure 7:
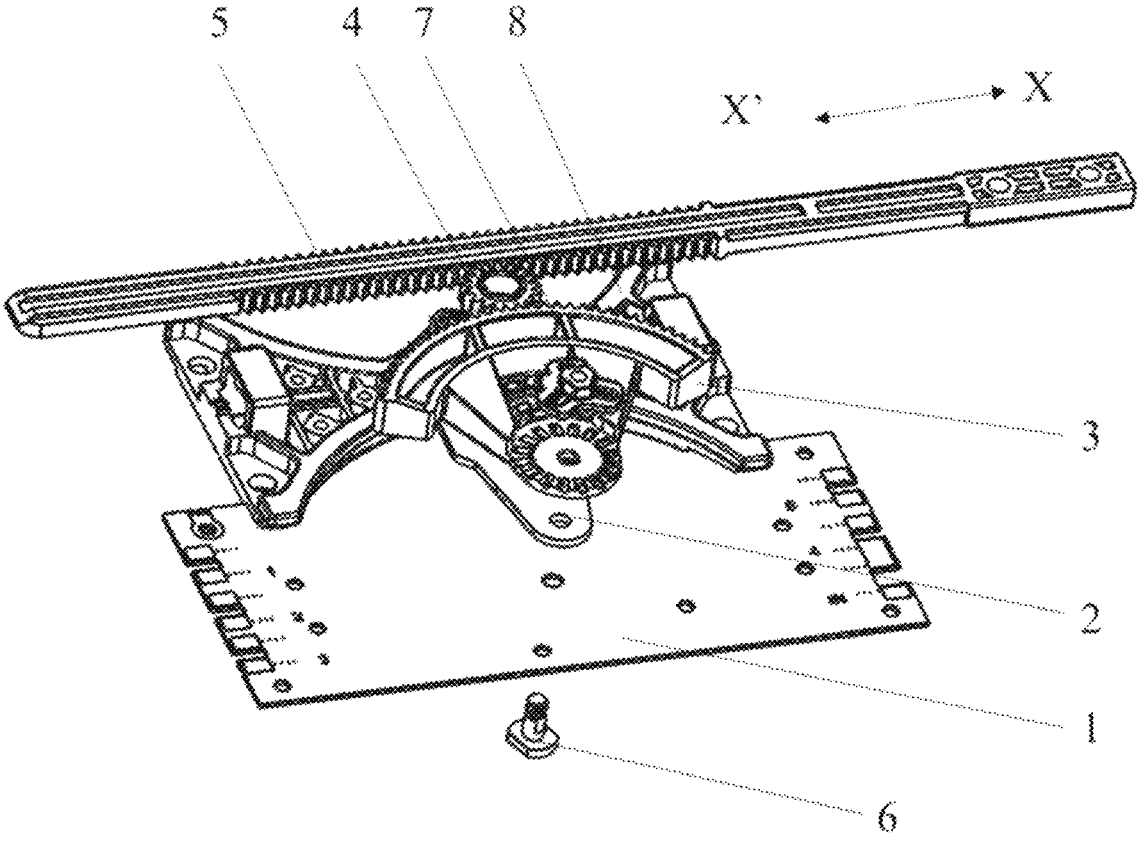
FIG. 7 is a schematic diagram of a phase shifter assembly according to another example embodiment of the present disclosure.

In some embodiments, as shown in FIG. 7, the first reversing mechanism 4 is disposed between the first gear 3 and the rack 5 and engages with the first gear 3 and the rack 5, respectively, such that the direction of the component of the linear velocity of the electrical contact between the first phase shifter 1 and the second phase shifter 2 in the moving direction of the rack is opposite to the moving direction of the rack. The first reversing mechanism 4 includes an odd number of gears. In some embodiments, the first reversing mechanism 4 includes one gear. In some embodiments, the first gear 3 and the second phase shifter 2 are integrally formed.

Figure 8:
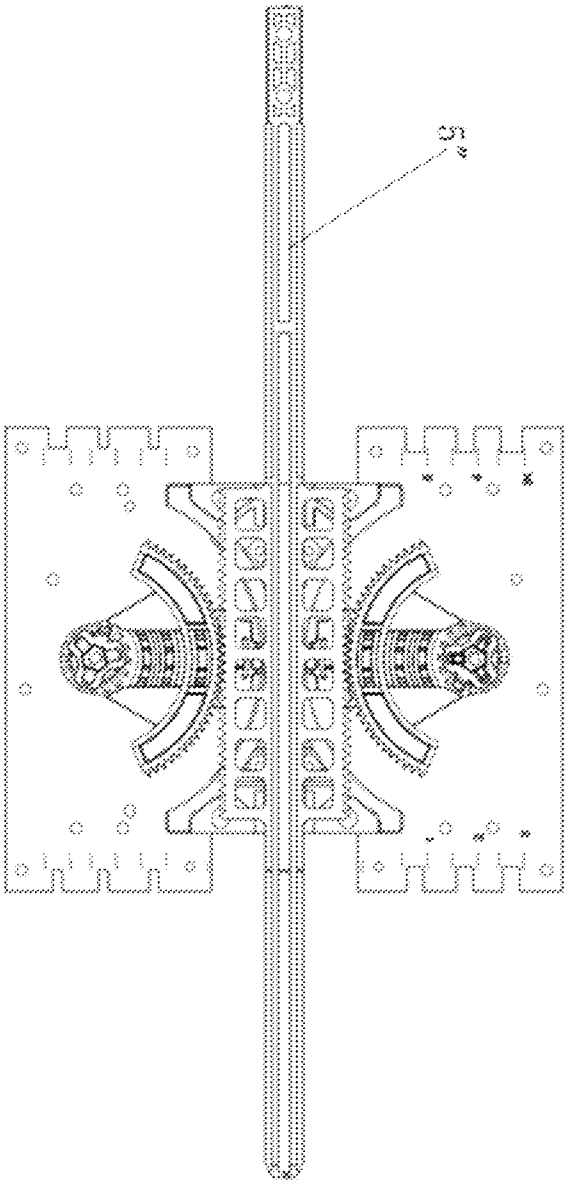
FIG. 8 is a schematic diagram of a phase shifter assembly according to another example embodiment of the present disclosure.

In some embodiments, as shown in FIG. 8, the phase shifter assembly also includes a third phase shifter including a fourth through-hole, a fourth phase shifter including a fifth through-hole and disposed at a side of the third phase shifter, a second gear including a sixth through-hole and disposed at a side of the fourth phase shifter facing away from the third phase shifter, and a second reversing mechanism. In the assembled state, the fourth through-hole, the fifth through-hole, and the sixth through-hole are aligned with each other. The second reversing mechanism is disposed between the second gear and the rack and engages with the second gear and the rack, respectively, such that the direction of the component of the linear velocity at the electrical contact between the third phase shifter and the fourth phase shifter in the moving direction of the rack is opposite to the moving direction of the rack. The rack is configured to have the second gear drive the fourth phase shifter to move relative to the third phase shifter, such that the electrical tilt angle of the antenna corresponding to the phase shifter assembly may be adjusted.

In addition, as shown in FIG. 8, a combination of the first phase shifter, the second phase shifter, the first gear, and/or the first reversing mechanism and a combination of the third phase shifter, the fourth phase shifter, the second gear, and/or the second reversing mechanism are arranged mirror-symmetrically with respect to the rack 5" or are arranged on a same side of the rack 5" in an array. In other words, the phase shifter assembly shown in FIG. 8 may or may not include the first reversing mechanism. Corresponding structures arranged mirror-symmetrically or in the array share the same rack, thereby achieving the transmission of multiple phase shifter assemblies and saving space. In some embodiments, the phase shifter assembly also includes a shield surrounding the first phase shifter and the second phase shifter, thereby ensuring the radio frequency performance of the phase shifter assembly.

Figure 9:
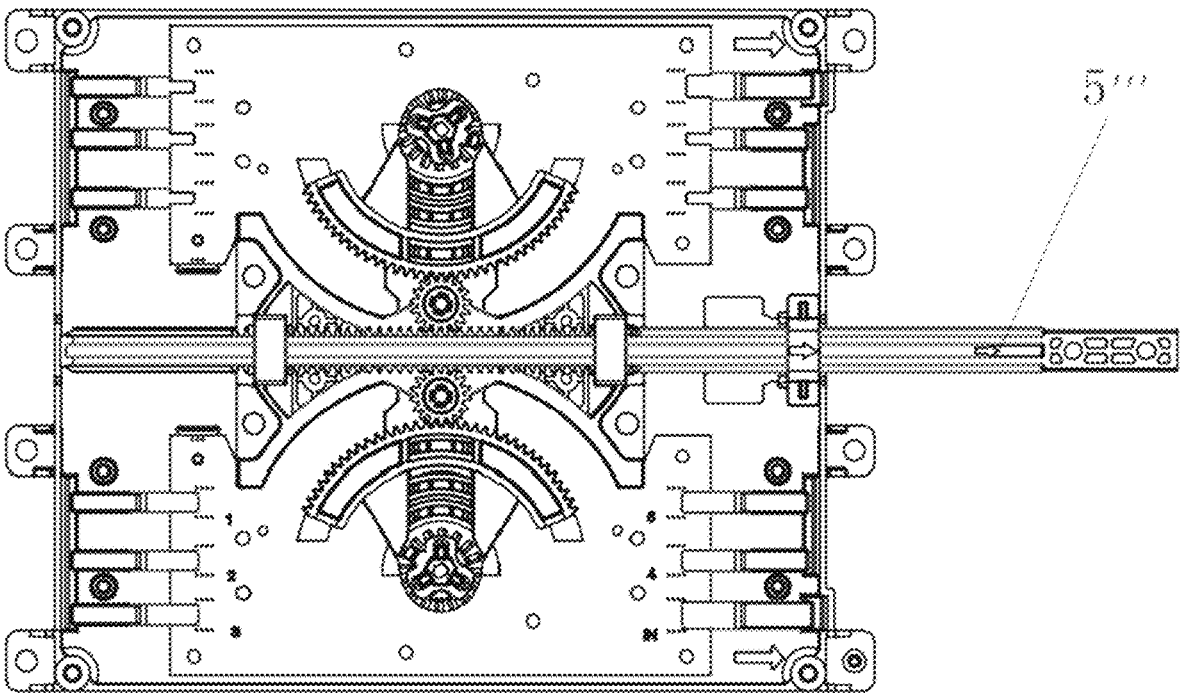
FIG. 9 is a schematic diagram of a phase shifter assembly according to another example embodiment of the present disclosure.

FIG. 9 is a schematic diagram of a phase shifter assembly according to another example embodiment of the present disclosure. As compared with the phase shifter assembly shown in FIG. 8, the phase shifter assembly shown in FIG. 9 includes two phase shifter assemblies arranged on both sides of a rack 5'''. Each of the two phase shifter assemblies includes a reversing mechanism with a gear. Thus, one rack 5''' drives both phase shifter assemblies.

Although various embodiments of the present disclosure have been described, it is apparent to those skilled in the art that various changes and modifications can be made without departing from the spirit and scope of the present disclosure to achieve one or more advantages of the present disclosure. For those skilled in the art, one or more components may be replaced by other components performing the identical functions. It should be understood that the features described herein with reference to a particular drawing can be combined with another feature in another drawing, even if such a case is not explicitly mentioned. In addition, the method of present disclosure may be implemented all by software being executed by a processor or may be implemented in a hybrid manner by a combination of hardware logic and software logic to achieve the same result. Such modifications to the embodiments of the present disclosure are intended to be covered by the appended claims.

What is claimed is:

1. A phase shifter assembly, comprising:

a first phase shifter including a first through-hole;

a second phase shifter including a second through-hole and disposed at a side of the first phase shifter;

a first gear including a third through-hole and disposed at a side of the second phase shifter facing away from the first phase shifter, wherein the first through-hole, the second through-hole, and the third through-hole are aligned with each other;

a rack configured to drive, through driving the first gear, the second phase shifter to move relative to the first phase shifter, to adjust an electrical tilt angle of an antenna corresponding to the phase shifter assembly; and a first reversing mechanism disposed between the first gear and the rack and engaged with the first gear and the rack, respectively, making a direction of a component of a linear velocity at an electrical contact between the first phase shifter and the second phase shifter in a moving direction of the rack opposite to the moving direction of the rack.

2. The phase shifter assembly according to claim 1, wherein:

the reversing mechanism includes an odd number of gears.

3. The phase shifter assembly according to claim 2, wherein:

the reversing mechanism includes one gear.

4. The phase shifter assembly according to claim 1, wherein:

the first gear and the second phase shifter are integrally formed.

5. The phase shifter assembly according to claim 1, further comprising:

a third phase shifter including a fourth through-hole;

a fourth phase shifter including a fifth through-hole and disposed at a side of the third phase shifter;

a second gear including a sixth through-hole and disposed at a side of the fourth phase shifter facing away from the third phase shifter, wherein the fourth through-hole, the fifth through-hole, and the sixth through-hole are aligned with each other; and a second revering mechanism disposed between the second gear and the rack and engaged with the second gear and the rack, respectively, making a direction of a component of a linear velocity at an electrical contact between the third phase shifter and the fourth phase shifter in the moving direction of the rack opposite to the moving direction of the rack, wherein the rack is configured to drive, through driving the second gear, the fourth phase shifter to move relative to the third phase shifter, to adjust the electrical tilt angle of the antenna corresponding to the phase shifter assembly.

6. The phase shifter assembly according to claim 5, wherein:

a combination of the first phase shifter, the second phase shifter, the first gear, and the first reversing mechanism and a combination of the third phase shifter, the fourth phase shifter, the second gear, and the second reversing mechanism are arranged mirror-symmetrically with respect to the rack.

7. The phase shifter assembly according to claim 5, wherein:

a combination of the first phase shifter, the second phase shifter, the first gear, and the first reversing mechanism and a combination of the third phase shifter, the fourth phase shifter, the second gear, and the second reversing mechanism are arranged in an array on a same side of the rack.

8. The phase shifter assembly according to claim 1, further comprising:

a first screw and a first nut, wherein the first screw passes through the first through-hole, the second through-hole, and the third through-hole to couple with the first nut to provide a fastening force among the first phase shifter, the second phase shifter, and the first gear.

9. The phase shifter assembly according to claim 8, wherein:

at least a portion of a cross-section of the first screw is a first D-shaped cross-section; and at least one of the second through-hole or the third through-hole includes a second D-shaped cross-section matching the first D-shaped cross-section.

10. The phase shifter assembly according to claim 8, wherein:

the first screw includes an elastic pressing member configured to deform elastically to provide an adjustable fastening force among the first phase shifter, the second phase shifter, and the first gear.

11. The phase shifter assembly according to claim 10, wherein:

the elastic pressing member includes multiple cantilever elastic structures evenly distributed along a circumferential direction around a center position of the first nut.

12. The phase shifter assembly according to claim 10, wherein:

the elastic pressing member includes a ratchet buckle;

the first gear includes at least one recess around the third through-hole; and the ratchet buckle is mechanically coupled with one of the at least one recess.

13. The phase shifter assembly according to claim 1, wherein:

the first gear includes a bridge elastic member associated with a pathway of the first phase shifter and/or the second phase shifter to apply a force on the second phase shifter toward the first phase shifter.

14. The phase shifter assembly according to claim 13, wherein:

the bridge elastic member includes a 1-bridge elastic member, a 2-bridge elastic member, or an N-bridge elastic member.

15. The phase shifter assembly according to claim 1, further comprising: a support member configured to support the rack and the first reversing mechanism, wherein:

the first gear includes an end elastic member at an end facing away from the third through-hole; and the end elastic member is coupled with the support member, and the support member presses the second phase shifter on the first phase shifter through the end elastic member.

16. The phase shifter assembly according to claim 1, further comprising:

a shield surrounding the first phase shifter and the second phase shifter.

* * * * *